US007931223B2

(12) United States Patent
Lee

(10) Patent No.: US 7,931,223 B2
(45) Date of Patent: Apr. 26, 2011

(54) DUST-PROOF STRUCTURE OF A CONE CRUSHER

(75) Inventor: Hou-Kun Lee, Yangmei Township, Taoyuan County (TW)

(73) Assignee: Minyu Machinery Corp. Ltd., Taoyuan County (TW)

( * ) Notice: Subject to any disclaimer, the term of this patent is extended or adjusted under 35 U.S.C. 154(b) by 0 days.

(21) Appl. No.: 12/197,382

(22) Filed: Aug. 25, 2008

(65) Prior Publication Data

US 2010/0288864 A1 Nov. 18, 2010

(51) Int. Cl.
*B02C 2/04* (2006.01)

(52) U.S. Cl. ..... 241/216

(58) Field of Classification Search ..... 241/207–216
See application file for complete search history.

(56) References Cited

U.S. PATENT DOCUMENTS 3,396,916 A * 8/1968 Kemnitz et al. ..... 241/290
5,934,583 A * 8/1999 Jean ..... 241/210

* cited by examiner

*Primary Examiner* — Mark Rosenbaum
(74) *Attorney, Agent, or Firm* — Leong C. Lei

(57) ABSTRACT

A dust-proof structure of a cone crusher below a cone core of the cone crusher includes primarily a dust ring which is suspended under the cone core, allowing the dust ring to operate concurrently with the cone core. Lubricant oil is provided between the dust ring and the cone core, enabling the dust ring to be tightly attached with a lip part of the cone core and operate successfully. The dust is prevented from entering into the cone crusher by ineffectiveness of a dust-proof function. Furthermore, a dust collar is attached under the dust ring, and an adjustment washer is provided between the dust collar and the cone core. When the dust ring is worn out, the adjustment washer is removed, and the dust ring is tightened again by screwing elements, thus preventing the dust from entering into the cone crusher due to the ineffectiveness of the dust-proof function.

2 Claims, 5 Drawing Sheets

DUST-PROOF STRUCTURE OF A CONE CRUSHER

BACKGROUND OF THE INVENTION a) Field of the Invention

The present invention relates to a dust-proof structure of a cone crusher, and more particularly to a dust-proof structure of a cone crusher, which is able to prevent dust from entering into the cone crusher due to ineffectiveness of a dust-proof function.

b) Description of the Prior Art

Gravels can be used in constructing a building or paving a road. The gravels are formed primarily by crushing stones using a cone crusher as the stones are provided with very high hardness. However, a large amount of dust will be resulted when the stones are crushed by the cone crusher. Therefore, the cone crusher needs to be installed with a dust-proof structure to prevent the dust from entering into the cone crusher.

Referring to FIG. 1, it shows a cutaway view of a conventional cone crusher, wherein the cone crusher 1 is provided with a main shaft 11, a lower end of which is surrounded by an eccentric seat 12, and an upper end of which is surrounded by a cone core 13, with a location on the cone core 13 and away from the main shaft 11, being provided with a lip part 131, a location at the lip part 131 being provided with a dust ring 14, and below the dust ring 14 being provided with a dust-proof spring 141 that supports the dust ring 14, allowing the dust ring 14 to be in contact with the lip part 131 of the cone core 13. When the cone crusher 1 operates, the main shaft 11 and the cone core 13 rotate eccentrically by the eccentric seat 12. In addition, an inner copper 111 is provided between the main shaft 11 and the eccentric seat 12, and a spherical copper 132 is provided under the cone core 13. When the main shaft 11 and the cone core 13 are rotating eccentrically, the cone core 13 and the main shaft 11 will rub the spherical copper 132 and the inner copper 111, respectively. Furthermore, when the cone crusher 1 is crushing stones, a large amount of dust will be resulted. Hence, the dust ring 14 will be supported by the dust-proof spring 141 and is in contact with and rubs the lip part 131 of the cone core 13, so as to prevent the dust from entering into the cone crusher 1.

Nevertheless, upon using the aforementioned cone crusher 1, following problems and shortcomings actually exist to be improved.

The dust ring 14 is supported by the dust-proof spring 141, is in contact with and rubs the lip part 131 of the cone core 13; whereas, when the main shaft 11 and the cone core 13 are rotating eccentrically, it is easy for the dust ring 14 and the dust-proof spring 141 to be dislocated and stuck, allowing the dust-proof function of the cone crusher 1 to be ineffective and enabling the dust to enter into the cone crusher 1, thereby quickly depleting the spherical copper 132 and the inner copper 111 and further damaging the cone crusher 1.

Accordingly, how to solve the aforementioned problems and shortcomings of the prior art is an aim of research and development for improvement by the related vendors.

SUMMARY OF THE INVENTION

The primary object of the present invention is to provide a dust-proof structure of a cone crusher, wherein a lip part is provided on a cone core, away from a main shaft; a lower side of the cone core is connected with a dust-proof structure which is provided with a dust ring that is suspended under the cone core; and the dust-proof structure is also provided with a dust collar that is attached under the dust ring, allowing the dust ring to operate concurrently with the cone core. By the aforementioned technologies, the problems existing in the conventional cone crusher that the dust ring and the dust-proof spring will be easily dislocated and stuck, resulting in the dust-proof function of the cone crusher to be ineffective, and the dust to enter into the cone crusher, so that the spherical copper and the inner copper can be depleted quickly, and the cone crusher can be damaged further, are solved; thereby achieving the practicability and progressiveness that the dust can be prevented from entering into the cone crusher due to the ineffectiveness of the dust-proof function.

Another object of the present invention is to provide a dust-proof structure of a cone crusher, wherein the dust-proof structure is further provided with an adjustment washer which is located between the dust collar and the cone core, and the dust collar is provided with a plurality of screwing elements that can be connected with the adjustment washer, such that when the dust ring is worn out, the adjustment washer can be removed and the dust ring can be tightened again by the screwing elements that a gap of lubricant oil between the dust ring and the lip part of the cone core can be maintained. In a same time, the practicability and progressiveness can be achieved by preventing the dust from entering into the cone crusher.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
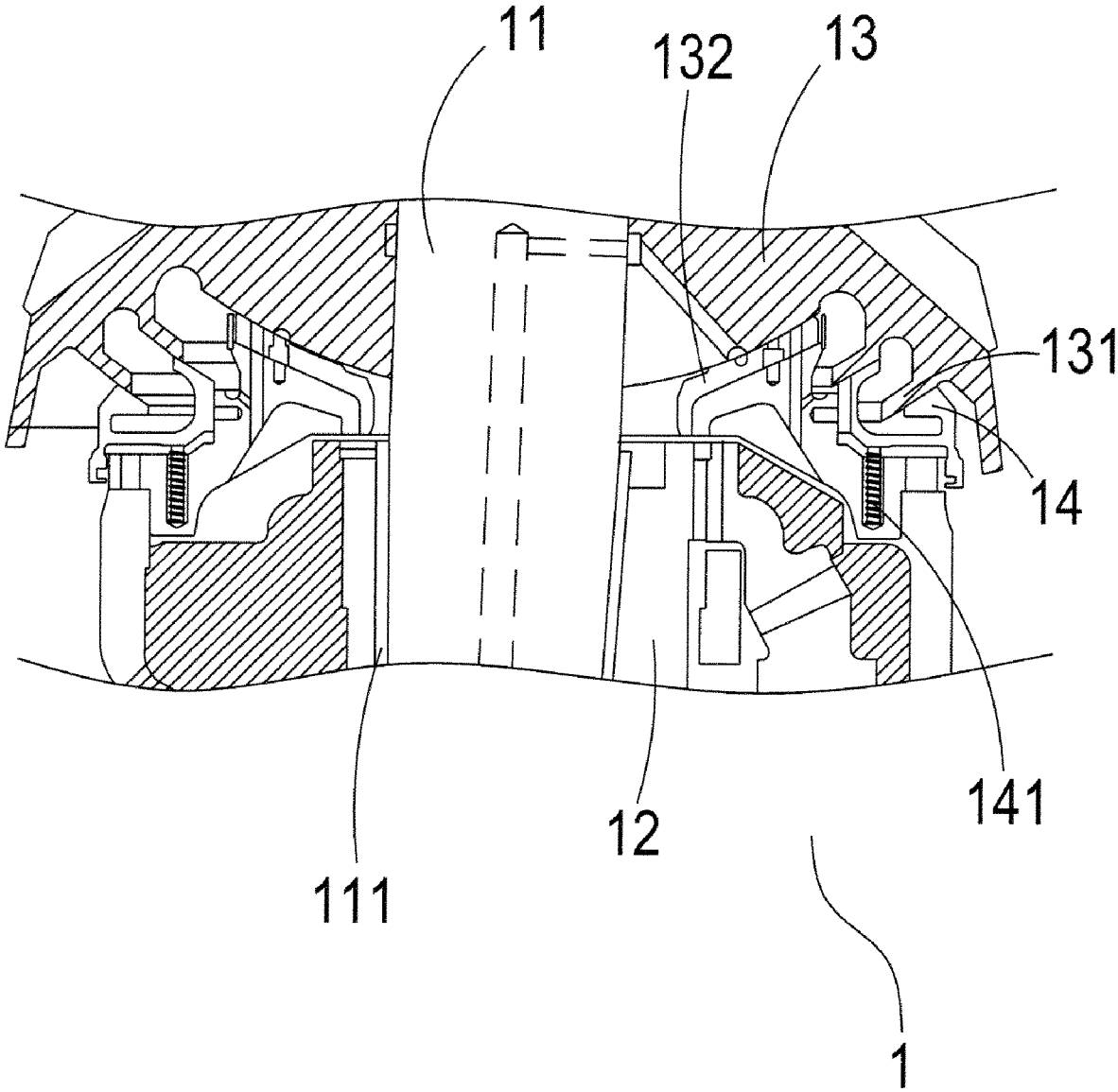
Fig. 1 Prior Art
FIG. 1 shows a cutaway view of a conventional cone crusher.
Figure 2:
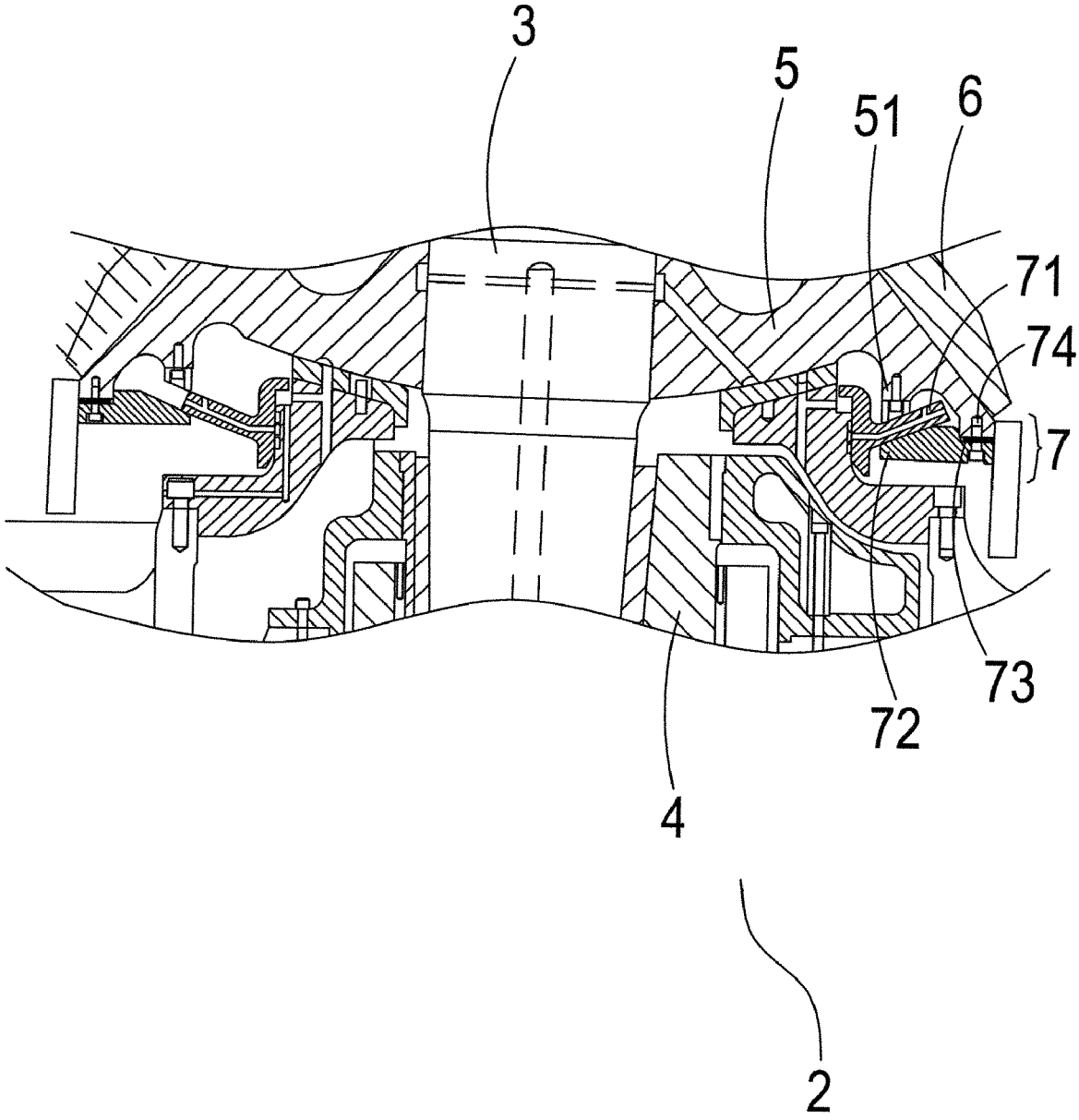
FIG. 2 shows a cutaway view of a preferred embodiment of the present invention.
Figure 3:
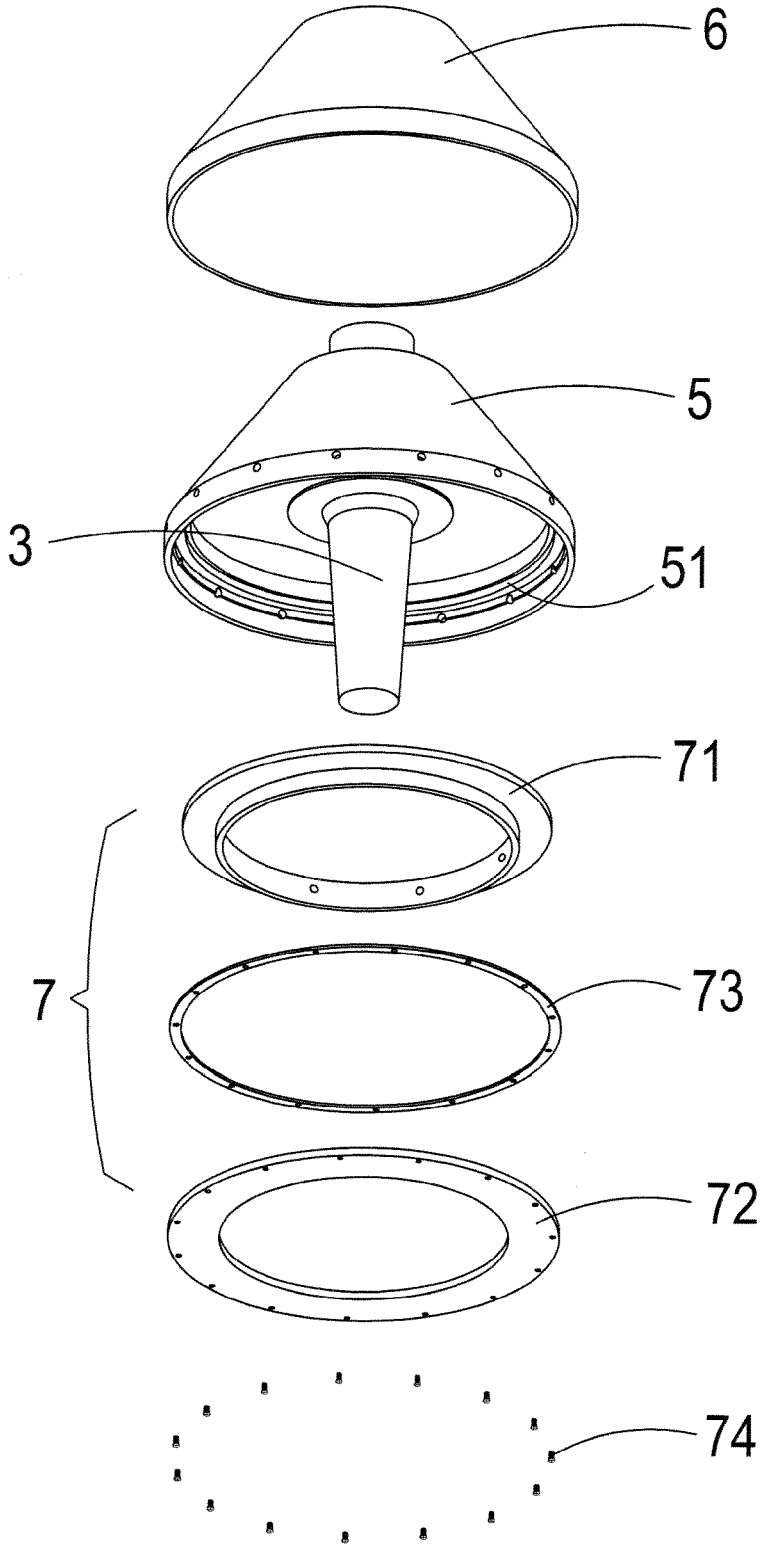
FIG. 3 shows a local exploded view of a preferred embodiment of the present invention.

Referring to FIG. 2 and FIG. 3, it shows a cutaway view and a local exploded view, of a preferred embodiment of the present invention, wherein a cone crusher 2 comprises primarily a main shaft 3, a lower end of which is surrounded by an eccentric seat 4, and an upper end of which is connected with a cone core 5 that surrounds the main shaft 3, with an exterior side of the cone core 5 being enclosed by a movable jaw plate 6, and a lower side of the cone core 5 being provided with a dust-proof structure 7. The dust-proof structure 7 includes primarily a dust ring 71 which is suspended under the cone core 5 and is attached at a lip part 51 of the cone core 5. A lower side of the dust ring 71 is attached with a dust collar 72 between which and the cone core 5 is further provided with an adjustment washer 73 that is fixed by screwing elements 74.

Figure 4:
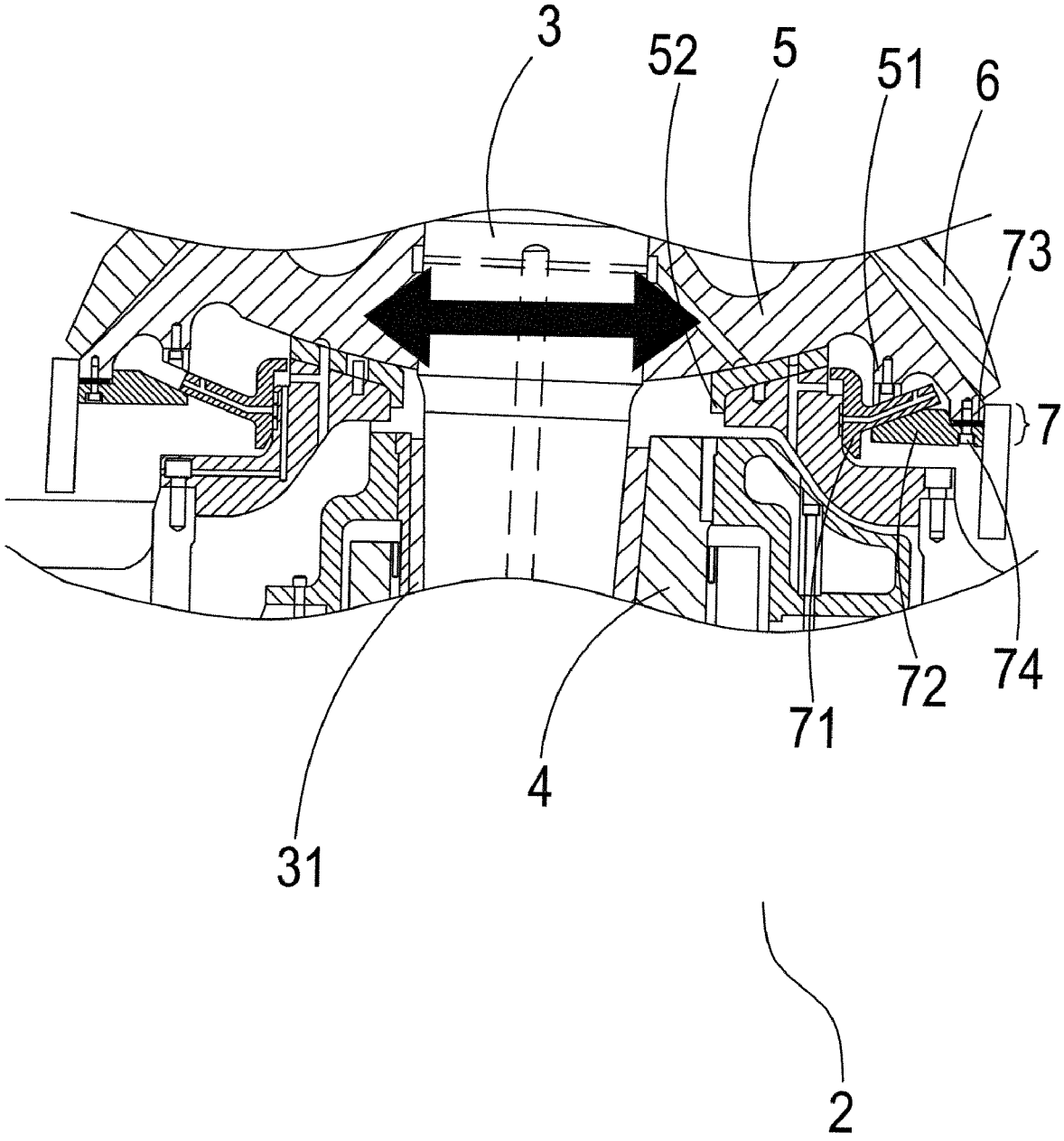
FIG. 4 shows a first schematic view of an implementation of a preferred embodiment of the present invention.
Figure 5:
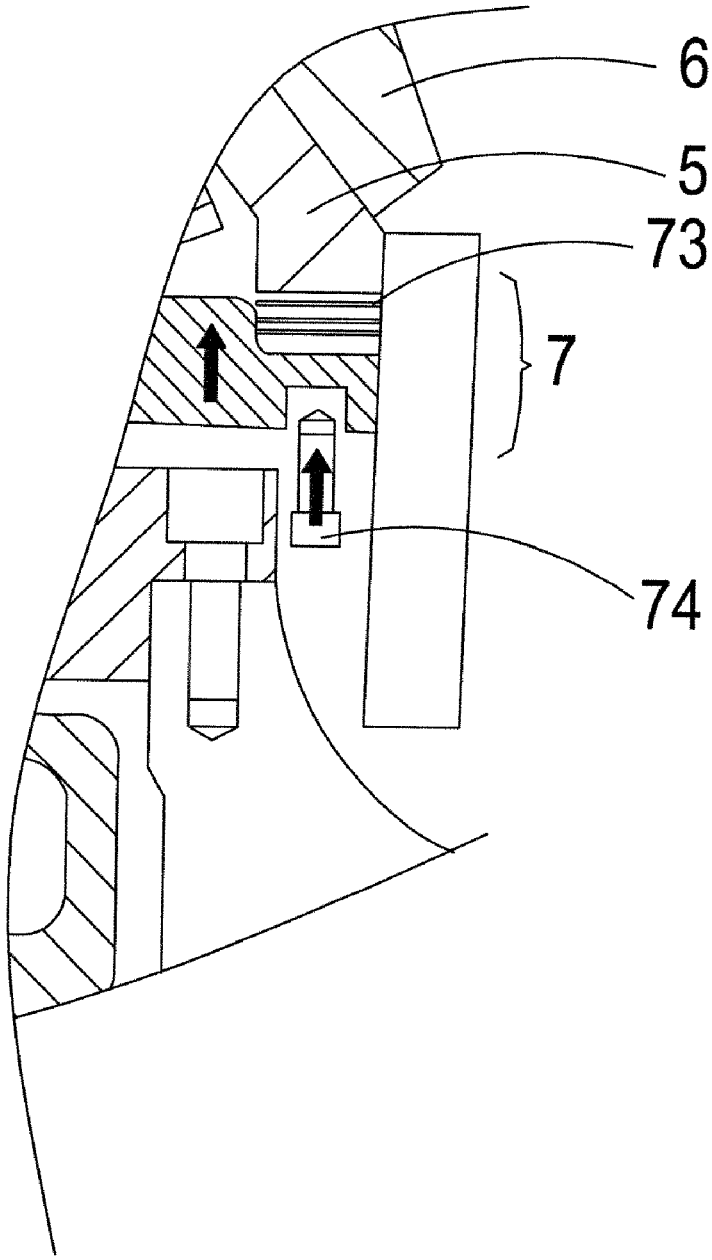
FIG. 5 shows a second schematic view of an implementation of a preferred embodiment of the present invention.

Referring to FIG. 4 and FIG. 5, it shows a first schematic view of an implementation and a second schematic view of an implementation, of a preferred embodiment of the present invention. When the cone crusher 2 is crushing stones, the movable jaw plate 6 is primarily used to crush the stones. The movable jaw plate 6 rotates eccentrically with the eccentric seat 4 through the main shaft 3 and the cone core 5, and when the main shaft 3 and the cone core 5 are rotating eccentrically, the main shaft 3 and the cone core 5 will rub an inner copper 31 and a spherical copper 52 respectively. Therefore, interior of the cone crusher 2 is provided with lubricant oil which circulates and lubricates. Moreover, when the cone crusher 2 is crushing the stones, a large amount of dust will be formed. In order to prevent the dust from entering into parts of the cone crusher 2 that require lubrication, the lower side of the cone core 5 is provided with the dust ring 71 of the dust-proof structure 7. The dust ring 71 is suspended under the cone core 5 to allow the dust ring 71 to operate concurrently with the cone core 5. In addition, lubricant oil is provided with between the dust ring 71 and the cone core 5, enabling the dust ring 71 to be tightly attached with the lip part 51 of the cone core 5, so as to prevent the dust from entering into the cone crusher 2 due to the ineffectiveness of the dust-proof function, thereby achieving a good dust-proof effect. The dust-proof structure 7 is also provided with the dust collar 72 which is attached under the dust ring 71, and the adjustment washer 73 is further located between the dust collar 72 and the cone core 5, with the dust collar 72 being provided with plural screwing elements 74 that can be connected with the adjustment washer 73 to lock the adjustment washer 73 on the cone core 5. On the other hand, when the dust ring 71 is worn out after a long time of usage, thickness of the adjustment washer 73 can be changed prior to be locked on the cone core 5 once more, by the screwing elements 74 on the dust collar 72; and a gap of lubricant oil between the dust ring 71 and the lip part 51 of the cone core 5 can be maintained, such that the ineffectiveness of the dust-proof function for the cone crusher 2 can be prevented effectively, and time of usage of the dust ring 71 can be increased.

Referring to all the drawings, the present invention is indeed provided with following advantages in comparison with the prior art, upon using:

1. On the cone core 5 and away from the main shaft 3 is provided with the lip part 51, and the lower side of the cone core 5 is connected with the dust-proof structure 7 which includes the dust ring 71 that is suspended under the cone core 5, enabling the dust ring 71 to operate concurrently with the cone core 5. In addition, lubricant oil is provided between the dust ring 71 and the cone core 5, allowing the dust ring 71 to be tightly attached with the lip part 51 of the cone core 5 that the dust can be prevented from entering into the cone crusher 2 due to the ineffectiveness of the dust-proof function.
2. The adjustment washer 73 is further provided between the dust collar 72 and the cone core 5, and is locked on the cone core 5 through the screwing elements 74. Therefore, when the dust ring 71 is worn out, the adjustment washer 73 can be removed to tighten the dust ring 71 again by the screwing elements 74, which maintains the gap of lubricant oil between the dust ring 71 and the lip part 51 of the cone core 5, and at a same time, prevents the dust from entering into the cone crusher 2 due to the ineffectiveness of the dust-proof function.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. In a cone crusher comprising a main shaft having a lower end and an upper end, an eccentric seat surrounding said lower end of said main shaft, a cone core surrounding said main shaft, a movable jaw plate enclosing an exterior side of said cone core, and a dust-proof structure provided at a lower side of said cone core, the improvement wherein said dust-proof structure comprises a dust ring, an adjustment washer, a dust collar and a plurality of screwing elements, said cone core having a lip part, said dust ring being suspended under said cone core and attached at said lip part of said cone core thereby allowing said dust ring to operate concurrently with said cone core, said dust ring having a lower side attached with said dust collar, said adjustment washer being mounted between said dust ring and said dust collar and fixed by said screwing elements, wherein lubricant oil is provided between said dust ring and said cone core thereby allowing said dust ring to be attached with said lip part of said cone core and therefore preventing dust from entering into said cone crusher, and when said dust ring is worn out, said dust ring can be replaced with a new dust ring, or removed to tighten said dust ring by said screwing elements.

2. The dust-proof structure as claimed in claim 1, wherein interior of said cone crusher is provided with lubricant oil which circulates and lubricates.

* * * * *